United States Patent [19]

Mohaupt

[11] Patent Number: 4,823,876

[45] Date of Patent: Apr. 25, 1989

[54] FORMATION STIMULATING TOOL WITH ANTI-ACCELERATION PROVISIONS

[76] Inventor: Henry H. Mohaupt, 1151 Estrella Dr., Santa Barbara, Calif. 93110

[21] Appl. No.: 777,360

[22] Filed: Sep. 18, 1985

[51] Int. Cl.[4] ..... E21B 37/00; E21B 43/263

[52] U.S. Cl. ..... 166/299; 166/63; 166/308; 166/311

[58] Field of Search ..... 166/299, 63, 308, 311; 102/314, 319, 321, 325, 326, 328, 331; 175/4.6

[56] References Cited

U.S. PATENT DOCUMENTS

| | | | |
|---|---|---|---|
| 2,732,016 | 1/1956 | MacLeod | 166/299 |
| 2,740,478 | 4/1956 | Greene | 166/299 |
| 2,915,125 | 12/1959 | Hanes | 166/63 |
| 3,031,964 | 5/1962 | Chesnut | 102/319 |
| 3,391,739 | 7/1968 | Venghiattis | 166/63 |
| 3,422,760 | 1/1969 | Mohaupt | 166/63 |
| 3,721,297 | 3/1973 | Challaesmbe | 166/299 |
| 4,018,293 | 4/1977 | Keller | 166/63 |
| 4,064,935 | 12/1977 | Mohaupt | 166/63 |
| 4,329,925 | 5/1982 | Kane et al. | 166/299 |

FOREIGN PATENT DOCUMENTS

| | | | |
|---|---|---|---|
| 758180 | 10/1956 | United Kingdom | 166/63 |

*Primary Examiner*—Hoang C. Dang

*Attorney, Agent, or Firm*—G. Turner Moller

[57] ABSTRACT

A device for fracturing a subterranean formation includes a propellant charge which generates, during combustion, a large quantity of high pressure combustion products. A drogue is provided on the device to prevent or minimize rapid upward movement of the device during combustion. This obviates "bird nesting" of the wire line, wire line damage and the like.

2 Claims, 3 Drawing Sheets

FORMATION STIMULATING TOOL WITH ANTI-ACCELERATION PROVISIONS

This invention relates to a technique for stimulating a subterranean formation and more particularly to a method and device which employs a charge of solid propellent material which generates, during combustion, a large quantity of high pressure gases.

There are a wide variety of techniques for stimulating a subterranean formation. The single most common technique is called "hydraulic fracturing" in which a large quantity of liquid is injected into a formation and carries a large quantity of sand or other proppant material. The liquid is injected into the formation so rapidly that a temporary fracture is created. The proppant material carried by the liquid is deposited in the fracture and prevents the fracture from completely closing at the cessation of pumping. Hydraulic fracturing works quite acceptably in a large variety of situations but indisputably has its disadvantages. Foremost among these disadvantages is cost. Hydraulic fracturing requires the use of expensive pump trucks, proppant material and a carrier liquid, all of which are more-or-less expensive depending on a wide variety of factors.

Another known technique for fracturing a subterranean formation includes the detonation of an explosive charge in the well bore which fractures the formation by shattering or rubblizing. This technique is somewhat less expensive than hydraulic fracturing but has several significant disadvantages. In its oldest form, explosive fracturing of a well is accomplished by placing one or more nitroglycerine charges in the well bore and then detonating them. The first disadvantage of explosive well fracturing is that considerable damage is often done to casing in the well or considerable junk is often left in the hole requiring expensive and time consuming efforts to clean up the well and repair the damage done. Although there are more modern explosive fracturing techniques available, these also suffer from the same disadvantages.

The second disadvantage of explosive well fracturing techniques involves the obvious danger in handling, transporting and detonating such explosives. Personnel of extensive training and experience are required for explosive fracturing techniques and such personnel are not always readily available.

A third type of well fracturing technique involves the use of a device incorporating a gas generating charge or propellant which is typically lowered into a well on a wire line and ignited to generate a substantial quantity of gaseous combustion products at a pressure sufficient to break down the formation adjacent the perforations. In this type approach, the desired fracturing is caused by the high pressure combustion products produced by the propellant rather than shock wave fracturing as in the case of the explosive techniques. It is this type fracturing technique that this invention most nearly relates. Typical disclosures of this type fracturing device are found in U.S. Pat. Nos. 3,422,760; 3,602,304; 3,618,521; 4,064,935 and 4,081,031.

One of the problems that has been noticed in the use of gas generating type fracturing tools is that the wire line cable is periodically kinked or damaged after lowering and igniting a gas generating tool in a well. Once in awhile, the cable acts as if it is stuck in the hole after activating one of these tools. When the cable acts as if it is stuck, there is considerable evidence to show that the cable was "bird-nested" in the hole since the cable shows considerable damage such as kinking. It was theorized that this has occurred because of upward movement of the top part of the gas generating tool during ignition and combustion thereof. Conceptually, it was thought that the propellent charge acts as if in a gun barrel pushing fluid, the cable head and cable upwardly.

The obvious solution to preventing upward motion of the top of a gas generating type stimulation tool and cable head is to provide a holddown which engages the well casing in some fashion to maintain some tension in the wire line. It turns out that this general approach has been suggested for use in various facets of the oil field. For example, U.S. Pat. Nos. 2,529,763; 2,704,031; 3,342,130 and 3,939,771 disclose a variety of techniques for anchoring a seismic charge in a hole drilled in the earth. Devices which appear similar are found in U.S. Pat. Nos. 156,673 and 1,560,315 which are used in conjunction with oil well torpedoes. Holddown mechanisms for perforating guns are found in U.S. Pat. Nos. 2,965,031 and 4,122,899. A holddown for a nitroglycerin type explosive charge for use in a well is found in U.S. Pat. No. RE. 21,444. Miscellaneous disclosures showing devices of this general type are found in U.S. Pat. Nos. 1,258,824; 2,790,388; 3,912,013; 4,278,025 and 4,329,925.

One of the problems with a mechanical holddown mechanism, particularly one that has moving parts, in the environment of gas generating fracturing tools is that pressures of substantial magnitude are generated for quite short periods of time. Because the pressures generated are so high, it will be evident that mechanisms of substantial strength are required. Since the elapsed time of a typical gas generating tool is so short, the inertia of ordinary types of holddown devices would prevent them from being manipulated to their operative position if that manipulation were to occur in response to the tool going off.

The development of gas generating type tools for fracturing hydrocarbons formations begin with tools such as shown in U.S. Pat. No. 3,422,760. At this stage of development, the propellent charge was housed in a thick walled, water tight metallic housing. The housing was water tight since the propellent material was soluble in liquids occurring in the well. The housing was of substantial strength since it had to withstand the substantial pressures occurring during combustion of the propellent material. In a very real sense, the use of a heavy wall, substantial metallic housing is self defeating since it necessarily limits the quantity of propellent material that can be introduced into a well.

The limitations inherent in wells are that tools run into them are long and slender. For example, a common completion technique is to cement $4\frac{1}{2}$ inch O.D. casing therein which has an internal diameter of about 4.0 inches. Realistically, one cannot run a tool larger than about 3.6 inches O.D. in $4\frac{1}{2}$ inch casing merely because of clearance problems. If one were to use a $\frac{3}{8}$ inch walled housing to transport propellent material, it will be seen that the propellent material charge itself ends up on the order of about $2\frac{3}{4}$ inches in diameter.

The problems are even worse in trying to design a heavy walled tool to run through tubing. The most common production tubing is $2\frac{3}{8}$ inches O.D. which has an internal diameter of slightly less than 2 inches. The largest tool that can be run in this tubing is about 111/16 inch O.D. With a heavy wall housing, it will be seen that the propellant diameter can be no more than about 1 inch.

Consequently, the development of gas generating type fracturing tools has been away from resuable propellent carriers which are capable of withstanding substantial pressures and has been directed at thin wall plastic or aluminum housings. These developments obviously allow greater quantities of propellant to be delivered at the stimulation site. In the devices incorporating plastic materials, the housing is more-or-less consumed by the combustion process. In thin walled aluminum devices, the ruptured, partially consumed housings are often retrieved but unfortunately are often left behind as junk in the hole.

Attempts to use unhoused propellent charges is acceptable if they have sufficient strength to avoid bending due to increased temperature in the well. There are some difficulties encountered with propellent charges which are merely painted since they tend to bow during heating. Because of the tolerances inherent in running a tool inside oil well casing or tubing, such bows cannot readily be tolerated.

It will accordingly be seen that the development of gas generating stimulation tools has proceeded from that of a heavy walled, water tight, reusuable housing to a thin walled, water tight, expendible plastic or metal housing to a generally unsatisfactory housingless propellent charge which is merely painted.

In summary, this invention comprises a device for stimulating a subterranean formation which utilizes a propellent charge to generate a large quantity of high pressure gaseous combustion products which are delivered into the formation. Means are provided on the tool for minimizing or reducing upward movement of the tool and cable head during combustion of the propellent charge in order to reduce or minimize cable damage and the likelihood of sticking any part of the assembly in the well due to bird-nesting of the cable.

It has been discovered that there are essentially two phenomenon which cause upward movement of the tool during combustion. The first effect occurs quite rapidly, commencing almost immediately after the onset of combustion. There is almost immediately rapid acceleration of the tool and cable head assembly. In one instrumented trial, maximum acceleration of 150 g's was recorded at 20 milliseconds after the ignitor was energized. By this time, the upward velocity of the cable head was measured to be 22 feet/sec. The rapid acceleration of the assembly is very likely attributable to the gas pressure acting on the bottom of the cable head since the maximum acceleration coincides with the maximum recorded pressure.

The maximum initial upward velocity of 22 feet/-second was maintained for about 10 milliseconds followed by a velocity decay to 13 feet/sec at 50 milliseconds after ignitor actuation. This rapid deceleration of the tool must be attributed to the mass of the conductive cable, since slack is introduced by the upward motion of the cable head assembly.

At 50 milliseconds, the cable head again begins to accelerate upwardly. This second upward acceleration of the tool is a much slower process and is attributed to movement of liquid in the well bore. It is believed that the liquid column in the well bore has remained almost stationary up to this point. At some time, the gas bubble created by combustion of the propellent charge begins to lift and accelerate the liquid column above it. As the liquid column begins to move, it exerts an increasing upward drag on the conductor cable. By 300 milliseconds, the tool has again attained an upward velocity of 22 feet/sec and has been displaced upwardly by 5 feet.

The expansion geometry of a gas bubble created by a gas generating type fracturing tool is influenced by factors such as the permeability of the formation being stimulated, the hydrostatic head of the liquid column in the well, the friction losses occurring as gas and liquid move in the well and perforations and the overburden pressure of the earth on the formation being fractured. Extensive observations have been made concerning the conductor cable behavior and the lift experienced by the liquid column in wells treated by gas generating techniques. In summary, wells exhibiting high permeability absorb the gaseous combustion products readily whereas low permeability zones vastly reduce the rate of gas penetration into the formation causing a substantial quantity of the evolved gas to remain in the well bore resulting in excessive lift of the liquid column. It is possible to at least partially offset this deficiency by increasing the hydrostatic head of liquid in the well bore.

Notwithstanding this partial solution, the conductor cable experiences potentially damaging upward motion and loss of tension which may result in kinking, separation of strands and in more severe cases, bird-nesting of the cable in the well bore and jamming of the sheave wheel at the well head.

The tools and approach of this invention is to minimize upward motion of the tool and conductor cable during gas generation. Since there are two causes of upward tool movement, it is natural that there are two solutions, one directed at each cause. To offset upward tool movement due to pressure acting upwardly on the bottom of the cable head assembly, there is provided an upwardly facing surface near the bottom of the tool. Pressure acting downwardly on this surface acts to offset the upwardly acting pressure on the cable head assembly. To overcome the slower process occurring because the liquid column is moving the cable head assembly upwardly, a drogue is suspended from the tool into a pocket of liquid below the gas bubble created by the combustion process. The drogue acts to retard upward movement of the tool since it must move upwardly in a stationary body of liquid. Because of the size of the drogue element relative to the internal diameter of the casing, the drogue element also has an element of a dash pot since the stationary liquid tends to flow around the drogue element, in the annular gap between the drogue element and the well casing.

It is accordingly an object of this invention to provide a gas generating type fracturing tool which minimizes or reduces upward motion of the tool during gas release. Another object of this invention is to reduce tool movement due to gas pressure acting on the cable head assembly.

A further object of this invention is to provide means for reducing upward movement of the tool caused by movement of the liquid column in the well bore.

Other objects and advantages of this invention will become more fully apparent as this description proceeds, reference being made to the accompanying drawings and appended claims.

IN THE DRAWINGS

Figure 1:
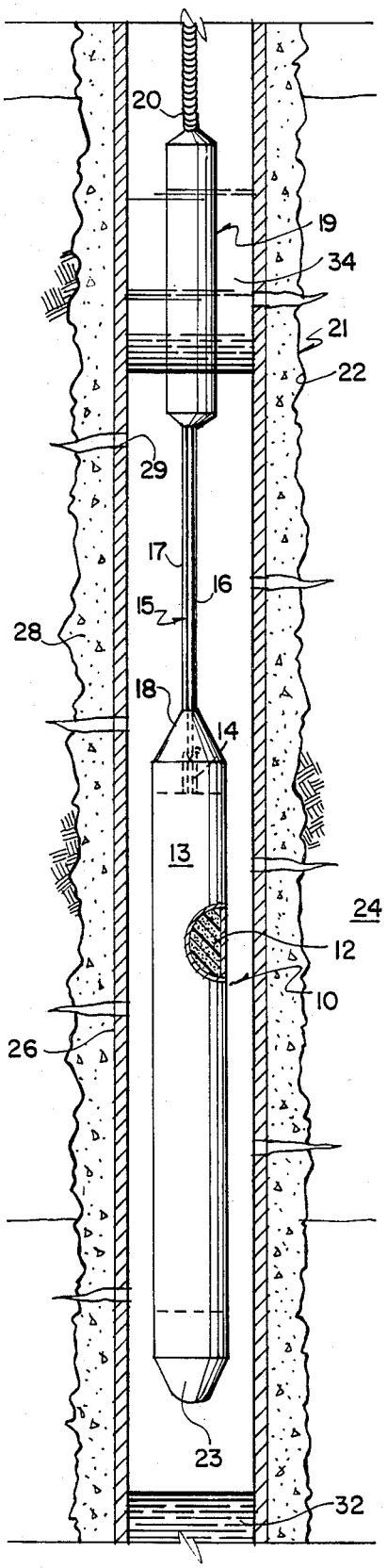
FIG. 1 (PRIOR ART)
FIG. 1 is a longitudinal cross-sectional view of a prior art tool which has been instrumented to provide certain readings.

Referring to FIG. 1, there is illustrated a prior art gas generating tool 10 comprising an elongate charge of propellent material 12 inside an expendable housing 13 which may be of thin walled aluminum, plastic or the like. An ignitor 14 is disposed in combustion transmitting relation with the upper end of the propellent material 12 and is electrically energized through a flexible bridle 15 having a suspension cable 16 and a pair of conductors 17. A top cover 18 encloses the upper end of the ignitor 14 and maintains it in a water tight condition.

Figure 2:
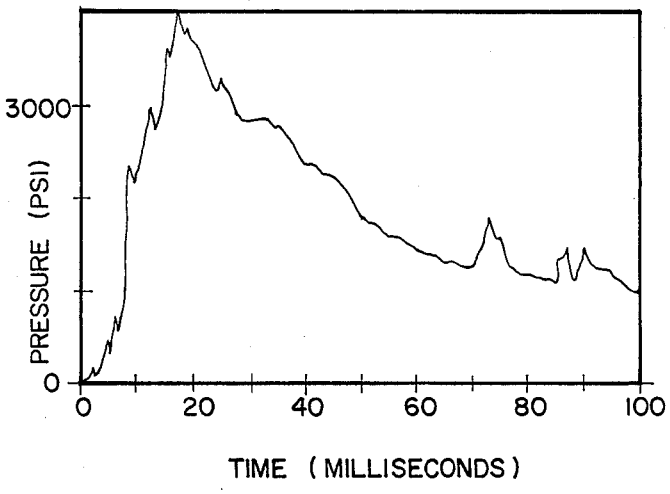
FIG. 2 is a chart showing the pressure-time relationship during activation of the tool of FIG. 1.
Figure 3:
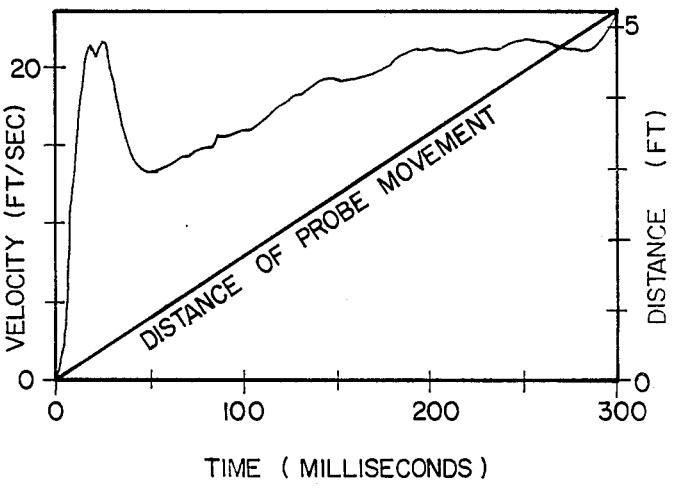
FIG. 3 is a chart showing the velocity and movement relationships verses time of the tool of FIG. 1.

The bridle 15 is connected to a cable head assembly 19 having therein a collar locater and instrumentation to record the pressure-time and velocity-time curves illustrated in FIGS. 2 and 3. The cable head assembly 19 is connected to a conductor cable 20 used to raise and lower the tool 10 in a well 21. It will be appreciated that the electrical signals needed to energize the ignitor 14 are transmitted through the conductor cable 20 to thereby initiate combustion of the propellant 12.

The well 21 is completed in a conventional manner and comprises a bore hole 22 which has been drilled into the earth to penetrate a hydrocarbon bearing formation 24. A casing string 26 has been lowered into the bore hole 22 and cemented therein by a cement sheath 28. A perforating gun (not shown) has been lowered into the well 20 and activated to create a plurality of perforations 29 extending from the formation 24 into the interior of the casing string 28 in a conventional manner.

A tool of the type shown in FIG. 1 was instrumented and ignited as in the prior art. The weight of the tool 10, including the propellent charge 12, the ignitor 14 and the cable head assembly 19, including the pressure probe, was 85 pounds. The cable head and pressure probe 19 had an outer diameter of 111/16 inches and was six feet long. Activation of the tool 10 produced the pressure-time curve of FIG. 2 and the velocity-time curve of FIG. 3. In FIG. 2, the abcissa originates upon the delivery of the electrical signal through the wire line 20. Almost immediately, the pressure sensed by the instrumentation begins to increase and increases very rapidly to achieve a maximum pressure of about 4000 psi 20 milliseconds after activation of the ignitor 14. The pressure then dwindled off to a value of about 1500 psi by the end of 60 milliseconds. The transient pressure peaks exhibited at 75 and 90 milliseconds are characteristic indications of a flareup or increased burning rate of the propellent charge .12 which occurs periodically during combustion of these type tools. At the end of 100 milliseconds, the pressure sensed by the instrumentation was about 1000 psi.

Since the housing 13 is either thin wall aluminum or thin wall plastic tubing, the housing is substantially incapable of transmitting tensile or compression forces. Thus, when the propellant 12 ignites, one of the first events is a substantial severing of the top cover 18 from the main body of burning propellant. Thus, the top cover 18 is propelled upwardly by the expanding gas bubble. The now free bottom portion of the tool 10, including the bull plug 23, is propelled downwardly by the action of the burning propellent charge.

Thus, the use of an expendable housing has two substantial side affects. First, some junk is often left in the hole. Second, by failing to tie the upper and lower parts of the tool together, thereby allowing the downward movement of the tool 10 to offset upward movement of the cable head 10, the tendency toward damage of the wire line 20 is exacerbated.

In the prior art device 10 of FIG. 1, the cable head assembly 19 is connected by the flexible bridle 15 to the tool 10. If the bridle 15 were a rigid connection, the effect of the gas bubble on the cable head assembly 19 would be worse than that shown in FIG. 3.

FIG. 3 shows that the tool 10 did not begin to move until the lapse of a small but finite period of time after the delivery of the ignition signal down the wire line 20. When the cable head 19 begins to move, FIG. 3 shows that it accelerated dramatically to reach an initial maximum velocity of about 20 feet per second about 20 milliseconds after the delivery of the electrical signal down the wire line 18. This increase in velocity amounts to an average acceleration of 150 g's during a 20 millisecond interval. As shown in FIG. 3, the velocity of the cable head assembly remains more-or-less constant for a short interval and then starts to decay rapidly to a value of about 13 feet per second at 50 milliseconds after ignition. The velocity then increases, at a slow rate, through the end of the 300 millisecond period shown in FIG. 3.

As mentioned previously, the initial peak acceleration is believed to be caused by gas pressure acting on the underside of the cable head assembly 19. Evidently, this effect peaks at about 20 milliseconds. Evidently, the gas pressure reaches the top of the cable head assembly 19 within a short time so that the acceleration due to gas pressure acting on the cable head dwindles off. It is suspected that this effect would dwindle off to zero and would not be noticed except for the acceleration of the cable head 19 due to liquid moving inside the casing string 26.

At about 50 milliseconds after ignition, the primary force acting on the tool 10 is upward movement of liquid inside the casing string 26. When the propellent charge 12 begins to burn, a bubble of high pressure gaseous combustion products forms adjacent the tool 10. Some of the liquid immediately around the tool 10 might be forceably injected into the formation 24. In any event, the liquid column present in the well prior to combustion is divided into a stationary liquid pocket 32 below the tool 10 and a moving liquid column 34. The upwardly moving liquid column 34 drags the wire line 20 with it thereby causing slack in the wire line 20. Because the cable head is moving upwardly in the well, the cable 20 has a tendency to kink or bird-nest creating the problems mentioned previously.

This upward movement is shown in FIG. 3 where the movement of the cable head 19 in the first 300 milliseconds of combustion amounted to about 5.3 feet.

Figure 4:
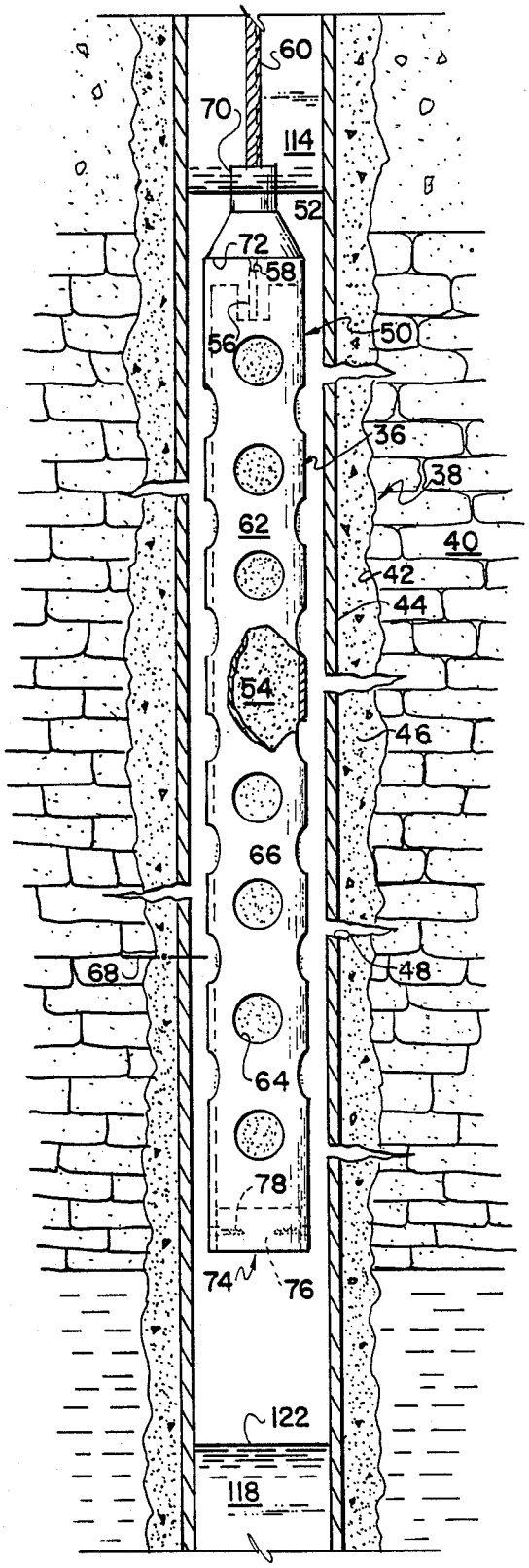
FIG. 4 is a longitudinal view of a tool of this invention suspended in a well during a combustion of the propellent charge therein.

Referring to FIG. 4, there is illustrated a gas generating tool 36 of this invention lowered inside a well 38 which has penetrated a formation 40 which is to be fractured. The well 38 includes a bore hole 42, a casing string 44 cemented in the bore hole 42 by a cement sheath 46. A multiplicity of perforations 48 have been formed between the formation 40 and the interior casing string 44 as is customary in the art.

The gas generating tool 36 of this invention comprises a frame 50 connected to a cable head assembly 52 and which receives a charge 54 of propellent material. An ignitor 56 includes a pair of leads 58 connected to a conductor cable or wire line 60. The wire line 60 acts to suspend the tool 36 in the well 38 and to deliver an electrical signal through the wires 58 to activate the ignitor 56 thereby initiating combustion of the propellent charge 54.

The frame 50 comprises an elongate rigid metallic tubular member or housing 62, open at both ends, and having a multiplicity of laterally facing openings 64 arranged symetrically along the tubular member 62. The openings 64 comprise a first and second series of longitudinally spaced openings in opposite sides of the tubular member 62 which have a common axis 66. The openings 64 also include a second and third series of longitudinally spaced openings having a common axis 68 wherein the axis 68 is substantially equal distant from the axes 66 of adjacent openings. The housing 62 is of substantial mechanical strength and is intended to be reusable. Typically, the housing 62 has a wall thickness on the order of $\frac{1}{4}'-\frac{3}{8}''$.

It will be seen that the frame 50 is open to liquids in the casing string 44. In addition, the openings 64 allow the gaseous high pressure combustion products to escape from the propellent charge 54 with minimum restriction. In the event the openings 64 are too small, there is a tendency for the housing 62 to expand and/or elongate during combustion. It is thought that this is due to plugging of the openings 64 and not allowing the hot combustion gases to escape.

The cable head 52 may include a collar locator 70 in order to facilitate positioning of the tool 36 at a desired location, as is well known in the art. The cable head 52 includes a lower downwardly facing surface 72 which is subjected to the pressure of gases generated during combustion of the charge 54 and which would be responsible for creation of a maximum velocity peak corresponding to that shown in FIG. 3. The lower end of the cable head assembly 52 is received in the upper open end of the frame 50 and is secured therein in any suitable fashion (not shown).

The propellent charge 54 contains a fuel in resin form and an oxidizer. The resin is polymerized into a unit. Typically, the oxidizer components are water soluble. In this event, the polymer is preferably of a water insoluble type so that the liquid in the well bore does not attack the propellent charge 54. In the alternative, the propellent charge 54 may merely be painted so that it is not attacked by well fluids. Since the propellant 54 is received inside the tubular housing 62, there is no danger of the propellent charge 54 bowing and thereby becoming stuck inside the casing or tubing through which it is run.

The ignitor 56 is of conventional design and typically includes a section of thin wall aluminum tubing having a rapidly burning material therein such as gun powder. When the ignitor 56 is energized through the wires 58, it combusts thereby raising the temperature of the propellent charge immediately adjacent thereto. This causes the propellant to begin burning thereby liberating high pressure combustion products through the opening 64.

Acting to minimize initial upward acceleration of the tool 36 due to gas pressure acting on the underside of the cable head assembly 52 is a bottom plate assembly 74. The bottom plate assembly 74 comprises a closure 76 received in the open end of the tubular member 62 and secured therein in any suitable fashion, as by the use of laterally extending threaded fasteners 78. It will be appreciated that the external diameter of the bottom plate assembly 74, including the wall thickness of the tubular member 72, is on the order of about the same as the outer diameter of the under surface 72 of the cable head assembly 52.

Figure 5:
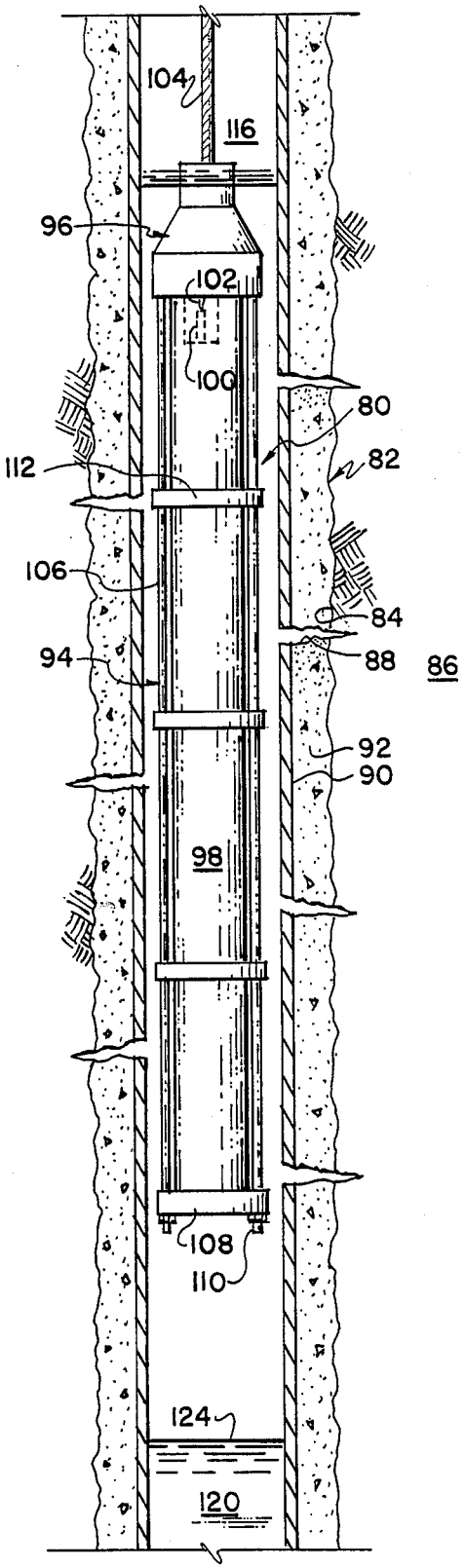
FIG. 5 is a view, similar to FIG. 4, of another embodiment of this invention.

Referring to FIG. 5, a gas generating tool 80, comprising another embodiment of this invention, is lowered into a well 82 comprising a bore hole 84 penetrating the formation 86 desired to be fractured. Perforations 88 communicate between the formation 86 and the interior of a casing string 90 cemented in the well bore 84 by a cement sheath 92.

The gas generating tool 80 comprises a frame 94 connected to a cable head assembly 96 and which receives a charge 98 of propellent material. An ignitor 100 includes a pair of leads 102 connected to a conductor cable or wire line 104 through the cable head assembly 96. The wire line 104 acts to suspend the tool 80 in the well 82 and to deliver an electrical signal through the wires 102 to activate the ignitor 100 thereby initiating combustion of the propellent charge 98.

It will accordingly be seen that the major difference between the tool 80 and the tool 36 lies in the construction of the frames 94, 50. The frame 94 comprises at least two, and preferably at least three, elongate equally spaced rods 106 which are of substantial strength in tension. The rods 106 connect the cable head assembly 96 to a bottom plate 108. The bottom plate 108 conveniently clamps the propellent charge 98 against the cable head assembly 96 as is allowed by the use of threaded fasteners 110 on the ends of the rods 106. A plurality of circumferentially extending support bands 112 extend on the outside of the rods 106 and act to prevent spreading thereof during the combustion process.

It will be seen that the embodiments of FIGS. 4 and 5 act to minimize the initial kick on the bottom of the cable head assembly because the cable head assembly is rigidly connected to the bottom plate which is, in accordance with Newton's Law, subjected to a force which is equal to and opposite in direction from the upward kick on the cable head assembly. This is in contrast to the prior art device of FIG. 1 wherein the housing 13 is incapable of transmitting a substantial tensile load.

FIGS. 4 and 5 illustrate the tools at a time when the propellent charges 54, 98 are just beginning to burn. It will be seen that a gas bubble is formed around the tools which acts to separate the liquid column in the well into a moving liquid column 114, 116 above the tools 36, 80 and a stationary liquid pocket 118, 120 below the tools. It might be thought that the interface 122, 124 between the stationary liquid pockets 118, 120 and the gas bubble would be immediately adjacent the lowermost perforation 48, 88. It is believed that the interfaces 122, 124 are substantially below the lowermost perforation for a variety of reasons. First, it might be thought that the liquid in the pockets 118, 120 might be completely incompressible. It is widely thought, for example, that water is completely incompressible. This is not quite true in practice because the waters encountered in the oil field typically contain a quantity of gas dissolved therein which renders the water only moderately incompressible. Second, the volume of the casing 44, 90 in the liquid pocket is subject to increasing because of the pressure applied thereto. It is not contended that the volume of the casing string increases dramatically. It is believed, however, that the volume of the casing string might increase on the order of 1–3% due to bulging of the casing during the application of pressure evolved by the tools of this invention. Third, a fair amount of the liquid in the pockets 118, 120 will be agitated, beaten into a froth and moved into the perforations. For these reasons, it is believed that the liquid interface 122, 124 will be substantially below the lowermost perforation.

Figure 6:
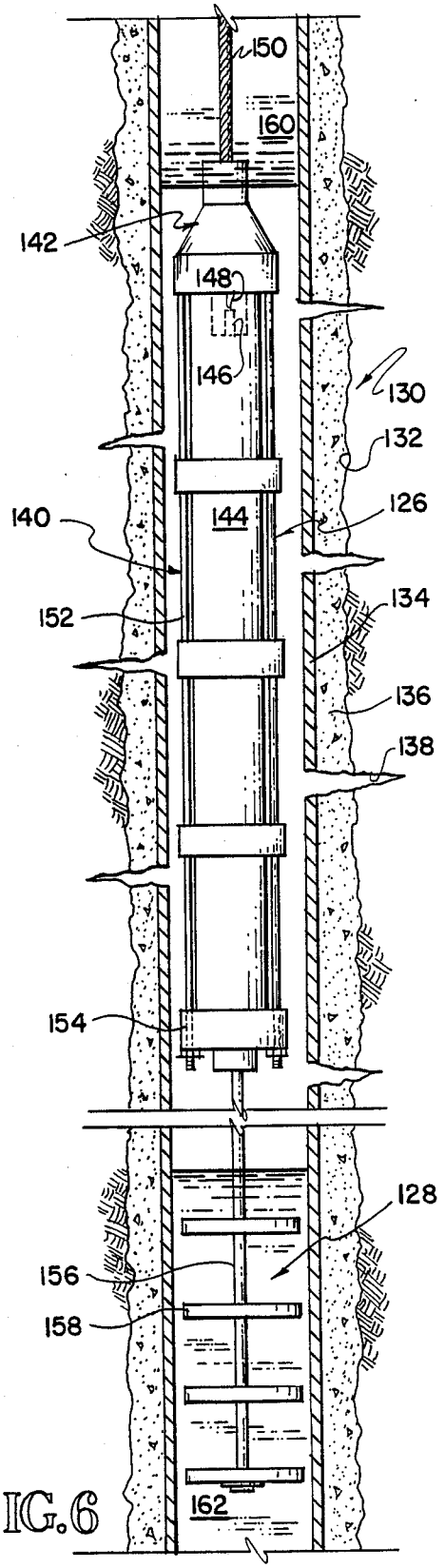
FIG. 6 is a view, similar to FIGS. 4 and 5, of another embodiment of this invention.

Referring to FIG. 6, there is illustrated a gas generating tool 126 comprising another embodiment of this invention. The tool 126 is substantially identical to the tool 80 except for the provision of a drogue 128 at the lower end thereof. The tool 126 is illustrated as being lowered inside a well 130 which has penetrated a formation which is to be fractured. The well 130 includes a bore hole 132, a casing string 134 cemented in the bore hole by a cement sheath 136. A multiplicity of perforations 138 have been formed between the formation and the interior of the casing string 134 as is customary in the art.

The gas generating tool 126 comprises a frame 140 connected to a cable head assembly 142 and which receives a charge 144 of propellent material. An ignitor 146 includes a pair of leads 148 connected to a conductor cable or wire line 150 through the cable head assembly 142. The wire line 150 acts to suspend the tool 126 in the well 130 and to deliver an electrical signal through the wires 148 to activate the ignitor 146 thereby initiating combustion of the propellent charge 144.

The frame 140 includes a plurality of elongate rods 152 connecting the cable head assembly 142 to a bottom plate 154. The drogue 128 is connected to the bottom plate 154 and includes a stem 156 having a plurality of drogue elements 158 extending transversely therefrom.

When the propellent material 154 is ignited, a bubble of high pressure combustion products form around the tool 126 to divide the liquid column in the well 130 into an upwardly moving liquid column 160 above the tool 126 and a stationary liquid pocket 162 below the tool 126. The function of the drogue 128 is to minimize or eliminate upward movement of the tool 126 due to the upwardly moving column 160 dragging the wire line 150 upwardly. As previously mentioned, this phenomenon is illustrated in the graph of FIG. 3 commencing about 50 milliseconds.

To this end, the droque 126 extends downwardly from the bottom plate 154 a sufficient distance to reside in the liquid pocket 162. The exact length of the drogue 128 is subject to wide variation. Directly, the drogue 128 may be very long, for example in excess of 150 feet. The practical difficulty with a drogue of this length lies in running it into the well in a convenient manner. Because of convenience in running it into the well, it is preferred that the drogue 128 be of a minimum length. Accordingly, it is preferred that the drogue 128 extend 3–15 feet below the bottom plate 154.

Theoretically, the stem 156 could be a bodily flexible cable since the drogue 128 applies a tensile force to the bottom of the tool 126. As a practical matter, however, the stem 156 should be rigid so that the drogue 128 runs into the well without becoming entangled.

The size, number and shape of the drogue elements 158 all affect the degree to which the drogue 128 retards upward movement of the tool 126. So long as the drogue elements 158 are far enough apart so that the turbulence created by one does not minimize turbulence created by the next adjacent drogue element, it appears that the effectiveness of the drogue 128 increases in proportion to the number of drogue elements 158. The exact minimum spacing between the drogue elements 158 has not yet been established. It does not appear, however, that this has any appreciable effect other than minimizing the length of the drogue 128. It is already evident that the drogue elements 158 may be spaced between 6–12 inches apart for running inside conventionally sized oil field casing, such as $4\frac{1}{2}$ inch O.D. or $5\frac{1}{2}$ inch O.D. pipe.

Because the casing into which the drogue 128 is run is circular in cross-section, the drogue elements 158 are desirably circular. If the drogue elements 158 are sufficiently large compared to the internal diameter of the casing string, it will be seen that the drogue 128 will act somewhat like a dash pot in retarding upward movement of the tool 126. Accordingly, the drogue elements 158 are preferably of circular cross-section having an area at least one half the internal area of the casing string 134.

When the upwardly moving liquid column 160 attempts to pull on the wire line 150, the drogue 128 retards upward movement of the tool 126 in much the same manner that a sea anchor affects movement of a sailboat.

Figure 7:
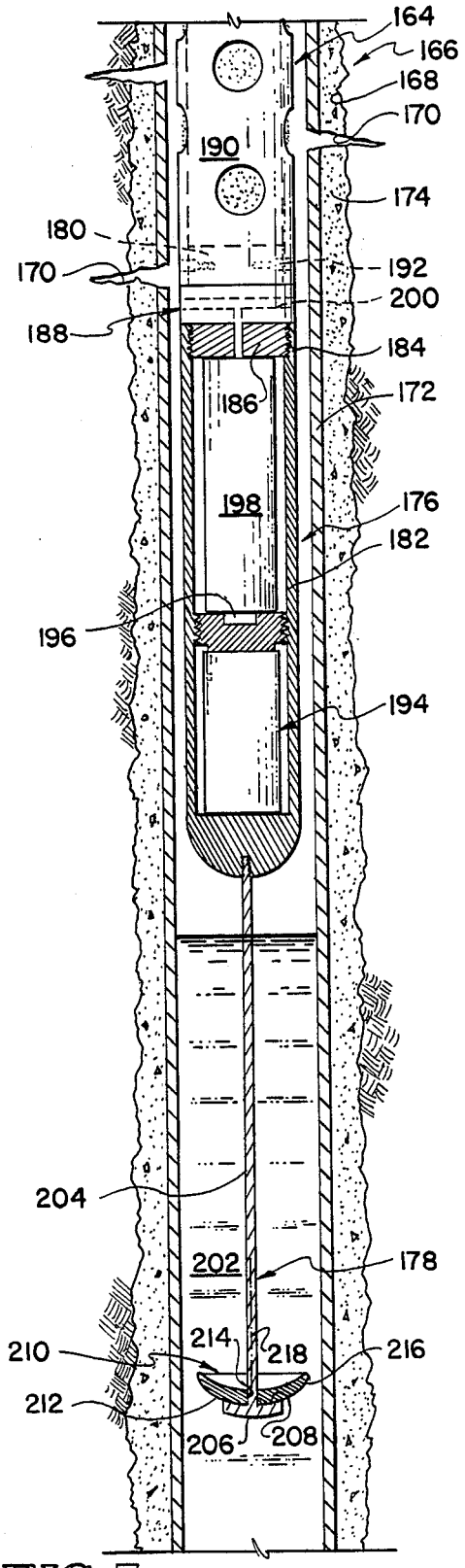
FIG. 7 is a view, similar to FIGS. 4–6, of a further embodiment of the gas generating tool of this invention.

Referring to FIG. 7, there is illustrated a gas generating tool 164 comprising another embodiment of this invention. The tool 164 is illustrated as lowered into a well 166 comprising a bore hole 168 penetrating the formation desired to be fractured. A multiplicity of perforations 170 communicate between the formation and the interior of a casing string 172 cemented in the well bore 168 by a cement sheath 174.

The gas generating tool 164 is substantially identical to the tool 36 except for the provision of an instrument housing 176 and drogue 178 connected to the bottom plate 180 of the tool 164.

The instrument housing 176 comprises an elongate tubular body 182 having female threads on the upper end 184 thereof receiving an exteriorly threaded metal plug 186 comprising a part of an adapter 188 having, as its upper end, the bottom plate 80 received in the housing 190 of the tool 164. Suitable set screws 192 secure the bottom plate 180 in the housing 190.

Inside the housing 182 is an accelerometer 194 sufficient to generate the data shown in FIG. 3. On top of the accelerometer 194 is a threaded plug 196 sufficient to captivate the accelerometer 194 in the housing 182.

On top of the threaded plug 196 is a pressure gauge 198 sufficient to generate the data shown in FIG. 2. The pressure gauge 198 communicates with the interior of the casing string 172 through a port 200 in the adapter 188.

It will accordingly be seen that the instrumentation package 176 allows data to be routinely taken during the operation of the gas generating tool 164. In this fashion, what occurs during the fracturing of the formation may be correlated with the productivity changes noted in the formation before and after fracturing.

The instrumentation package 176 also comprises part of the stem positioning the drogue 178 below the bottom plate 180 a distance sufficient to keep it in a stationary liquid pocket 202 below the tool 164. The drogue 178 is of somewhat different configuration than the drogue 128. One of the problems with the drogue 128 is that it cannot be run rapidly downwardly through a liquid column since it is equally effective to retard movement in both directions. In contrast, the drogue 178 is uni-directional and acts to retard upward movement of the tool 164 to a much greater extent than it retards downward movement. Accordingly, the tool 164 can run into the hole much more rapidly than can the tool 126.

To this end, the drogue 178 comprises a rigid metal stem 204 secured to the bottom end of the instrumentation package 176 providing a cup support 206 on the lower end thereof. The cup support 206 preferably provides an upper surface 208 which is upwardly concave providing a curved support for a flexible cup 210 received about the stem 204.

The cup 210 is preferably of bodily flexible material having a lower surface 212 received on the upper surface 208 of the cup support 206 and extends laterally beyond the circumference of the support 206. The cup 210 is generally crescent shaped in cross-section providing a central aperture 214 receiving the stem 204. Accordingly, the cup 210 provides an annular wall 216 which decreases in thickness radially away from a longitudinal axis 218.

Consequently, the annular wall 216 flexes outwardly toward the interior surface of the casing string 172 when the drogue 178 moves upwardly in the stationary liquid pocket 202. The cup 210 accordingly acts as a drogue element to retard movement of the drogue 178 since the annular wall 216 acts much like a swab cup.

It is preferred that the cup 210 not expand sufficiently to place the annular wall 216 against the interior of the casing string 172 so that the drogue 178 may be pulled out of the well 166 without swabbing the casing string 172.

It will be evident that certain compromises are in order in the construction of the drogue 128, 178. Ideally, the drogues 128, 178 should be sufficiently effective to retard upward movement of their respective gas generating tools 126, 164 while allowing the tools 126, 164 to be run into the wells at a practical speed.

Although the invention has been described in its preferred forms with a certain degree of particularity, it is understood that the present disclosure is only by way of example and that numerous changes in the details of construction and in the combination and arrangement of parts may be resorted to without departing from the spirit and scope of the invention as hereinafter claimed.

I claim:

1. In combination, a well having a casing string extending into the earth sufficient to penetrate a subterranean formation and having a column of liquid therein adjacent the formation, a plurality of perforations including a lowermost perforation communicating the casing string with the formation and an apparatus for increasing the productivity of the subterranean formation, comprising means comprising an elongate charge of propellent material for generating a bubble of high pressure combustion products in the well adjacent the formation for dividing the liquid column into a stationary liquid pocket below the charge and perforations and an upwardly moving liquid column above the charge and perforations;

a wire line for raising and lowering the charge and for transmitting an electric signal;

an initiator for initiating combustion of the propellent charge in response to an electric signal delivered through the wire line; and means connected to the wire line for retarding upward movement of the wire line caused by the upwardly moving liquid column, including a disc shaped drogue suspended below the charge and disposed entirely below the lowermost perforation out of sealing contact with the casing string in the stationary liquid pocket for retarding upward movement of the wire line by moving the drogue through the stationary liquid pocket.

2. A method for stimulating a subterranean formation penetrated by a well having a casing string providing perforations including a lowermost perforation communicating with the formation and having a column of liquid in the casing string adjacent the formation, comprising lowering a propellant charge on a wire line into the liquid in the well;

igniting the propellant charge and creating a bubble of high pressure gaseous combustion products adjacent the formation intermediate the liquid column for creating a liquid pocket below the perforations and below the bubble;

delivering the gaseous combustion products into the formation; and suspending a disc shaped drogue, connected to the wire line, in the liquid pocket entirely below the lowermost perforation out of sealing contact with the well and retarding upward movement of the wire line by moving the drogue through the liquid pocket.

* * * * *